US005234582A

United States Patent [19]

Savoie

[11] Patent Number: 5,234,582

[45] Date of Patent: Aug. 10, 1993

[54] ROOF DRAIN COVER

[76] Inventor: Murphy B. Savoie, 5381, Notre-Dame Ouest, Montreal, Quebec, Canada, H4C 1T7

[21] Appl. No.: 848,691

[22] Filed: Mar. 9, 1992

[30] Foreign Application Priority Data

Oct. 22, 1991 [GB] United Kingdom ..... 9122357

[51] Int. Cl.[5] ..... E03F 5/14

[52] U.S. Cl. ..... 210/163; 210/459; 285/42; 52/12

[58] Field of Search ..... 210/163, 247, 459; 285/308, 309, 42; 454/14, 367; 52/12, 712, 714

[56] References Cited

U.S. PATENT DOCUMENTS

| | | | |
|---|---|---|---|
| 1,487,161 | 4/1924 | Holt | 285/42 |
| 1,918,509 | 7/1933 | Wilcox | 285/42 |
| 1,999,277 | 4/1935 | Boosnex | 285/42 |
| 2,099,875 | 11/1937 | Weaver | 285/206 |
| 2,740,490 | 4/1956 | Matheis | 285/42 |
| 2,976,796 | 2/1959 | Anthony et al. | 454/14 |
| 4,206,692 | 6/1980 | Johnston | 454/367 |
| 4,216,790 | 8/1980 | Stoltz | 210/163 |
| 4,535,686 | 8/1985 | Hisey | 454/14 |
| 4,655,913 | 4/1987 | Boersma | 210/163 |
| 4,799,713 | 1/1989 | Uglow | 285/42 |

*Primary Examiner*—Peter Hruskoci
*Assistant Examiner*—Robert James Popovics
*Attorney, Agent, or Firm*—Roland L. Morneau

[57] ABSTRACT

A roof drain cover characterized by an open-end cage adapted to sit over the top of a roof drain. The cage has a top face and a peripheral wall. The top face and the peripheral wall are provided with apertures for allowing water circulation therethrough. A pair of leg members which are suspended from the top wall, have a portion extending below the cage for penetrating into the drain. A pair of bolts are slidingly mounted through the peripheral wall and are coaxially mounted in opposite direction, each of said bolts being threadedly engaged with a corresponding leg member for pulling apart the leg members in the direction of the peripheral wall. When the cage is mounted over the drain, the portions extending below the cage are accordingly adapted to abut against the inner surface of the drain for frictionally retaining the cage to the drain.

9 Claims, 4 Drawing Sheets

ROOF DRAIN COVER

BACKGROUND OF THE INVENTION

1. Field of the Invention

This invention relates to roof drain covers particularly of the commercial and industrial type. The roof drain cover is adapted for a large variety of roof drains having different diameters. The cover is also of a simple design so as to be less expensive while providing the required protection and the means for positively being retained to the roof drain. Such means are especially selected to increase the friction between the cover and the drain.

2. Prior Art

A search of the prior art has not revealed any pertinent reference.

U.S. Pat. No. 2,099,875 shows a cage-like cover on top of a vent pipe.

Another vent pipe cover is disclosed in the U.S. Pat. No. 4,206,692 which is adapted to grip with side tabs on the upper end of the vent pipe.

U.S. Pat. Nos. 2,976,796 and 4,535,686 is directed to chimney cap screens with resilient arms extending down from the screen and into the chimney. They show legs which are adapted to be positively placed and abut against the interior periphery of the chimney.

SUMMARY OF THE INVENTION

The roof drain cover according to the invention comprises an open-end cage adapted to sit over the top of a roof drain. The cage has a top face and a peripheral wall. The top face and the peripheral wall are provided with apertures for allowing air circulation therethrough. A pair of leg members which are suspended from the top wall, have a portion extending below the cage for penetrating into the vent pipe. A pair of bolts are slidingly mounted through the peripheral wall and are coaxially mounted in opposite direction, each of said bolts being threadedly engaged with a corresponding leg member for pulling apart the leg members in the direction of the peripheral wall. When the cage is mounted over the roof drain, the portions extending below the cage are accordingly adapted to abut against the inner surface of the drain for frictionally retaining the cage to the drain.

DETAILED DESCRIPTION OF THE INVENTION

Figure 2:
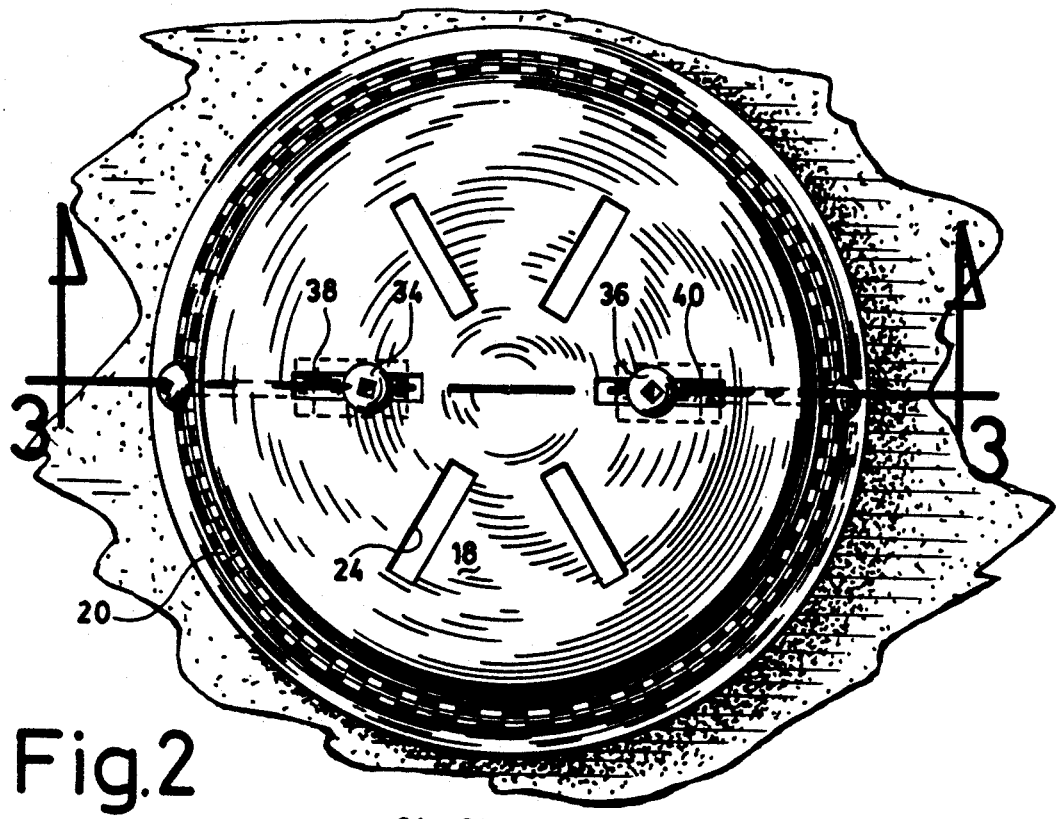
FIG. 2 is a top plan view of the cover as shown in FIG. 1, FIGS. 3 and 3*a* are cross-sectional views along line 3—3 of FIG. 2, corresponding to two different dimensions of the roof drain.
Figure 1:
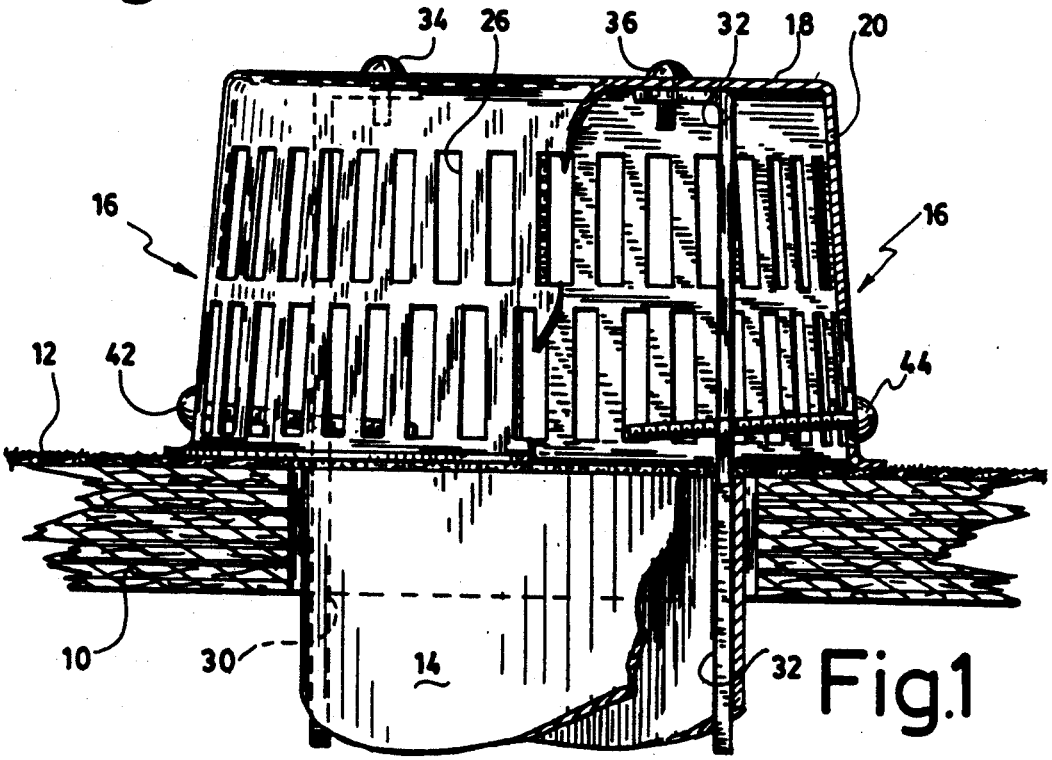
FIG. 1 is a side view of roof drain cover mounted a roof drain, one part of the cover being torn away.

FIG. 1 schematically illustrates a roof 10 of a building with a roof protecting lining 12 through which a roof drain 14 extends. An open bottom end cage 16 is located above the drain 14 to refrain debris from entering in it. The cage 16 is essentially made of a top face or roof wall 18 surrounded by a peripheral wall 20 extending from the top face 18 down to a marginal ledge 22 and adapted to sit on the roof 10 around the drain 14. The top face 18 and the peripheral wall 20 are provided with apertures 24 and 26 to allow water circulation therethrough while stopping leaves and other undesirable debris to enter the drain 14. The apertures 24 on the top face 18 are preferably made as slots directed along radial directions when it serves an additional purpose explained later. The apertures 26 around the peripheral wall 20, preferably vertical, suitably fit a purpose also explained later. The vertical apertures 26 are elongated slots and are preferably made along two superposed rows in a staggered manner so as not to weaken the strength of the cage 16.

Figure 3A:
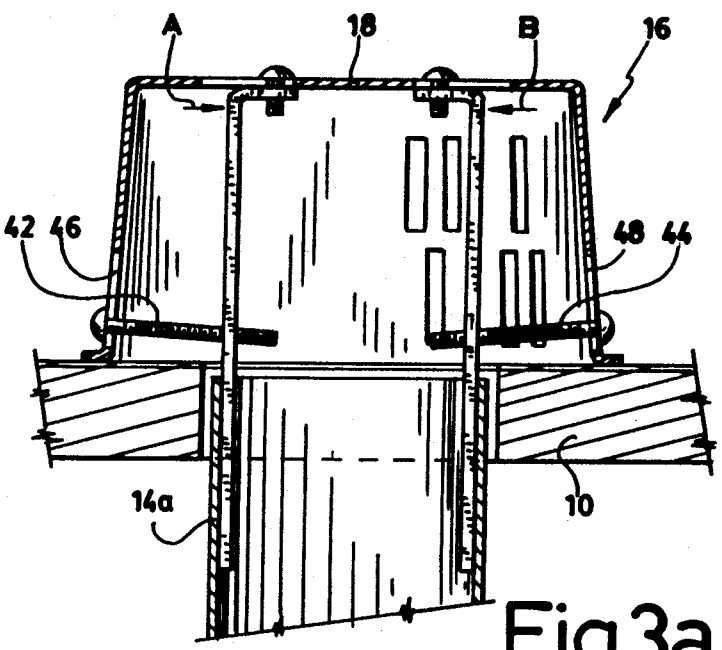
Figure 4A:
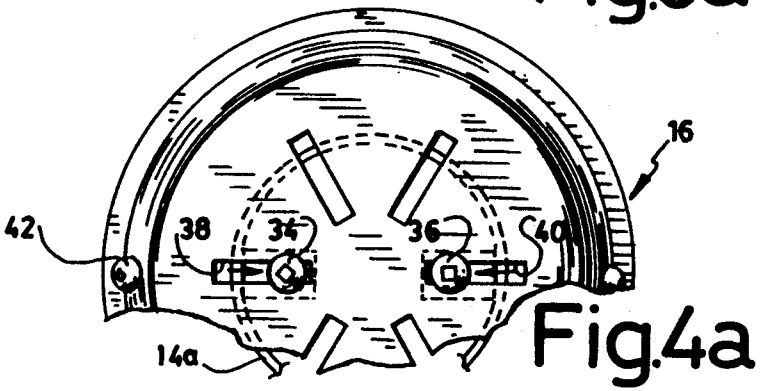
FIGS. 4 and 4*a* are top plan views of FIGS. 3 and 3*a* respectively.
Figure 3:
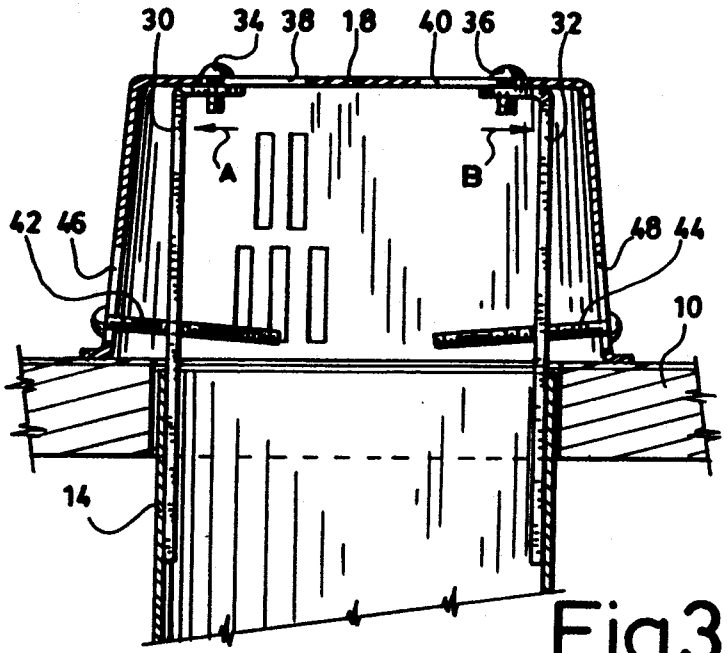
Figure 4:
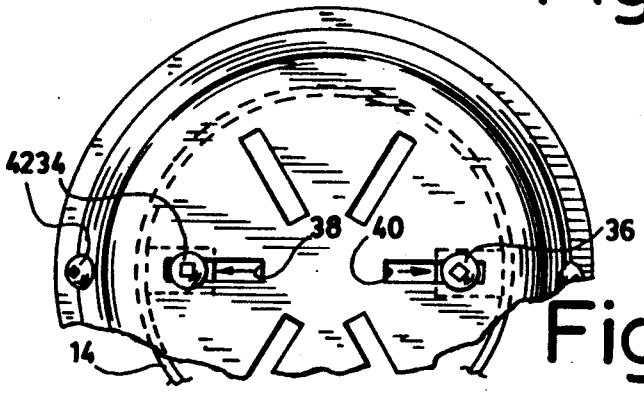

Roof drain cover having apertures on their top wall and their peripheral wall are known. However, in the present invention, some of these apertures have the purpose of supporting and tightening two legs which are adapted to retain the drain cover to the drain itself. A pair of leg members 30 and 32 are suspended from the roof wall 18 with a pair of bolts 34 and 36 respectively. The bolts 34 and 36 are positioned in two diametrically opposite slots 38 and 40 and are adapted to slide therethrough along arrows A and B so as to vary the distance between each other, such distance corresponding to the inner diameter of the drain 14. As illustrated in FIG. 3, the leg members 30 and 32 are adjusted to a drain 14 having a large diameter while in FIG. 3*a*, the same leg members are adjusted to abut against the inner surface of a drain 14*a* having a small diameter.

In order to tighten the leg members 30 and 32 against the inner periphery of the drain 14, bolts 42 and 44 are mounted through respective slots 46 and 48 adjacent and facing the leg members 30 and 32 and are threadedly extending through the corresponding adjacent leg members 30 and 32. It is obvious that the head of each of the bolts 34, 36, 42 and 44 are larger than the corresponding slots through which they extend so as to abut against the peripheral wall 20 of the cage. In order to tighten the lower portion of the leg members 30 and 32 which are inside the drain 14, each of the bolts 42 and 44 are turned to pull the leg members apart so as to come into abutment with the inside surface of the drain 14. This tension prevents the removal of the cage 16 from the drain 14. All the bolts 42 and 44 are sufficiently long so as to adjust to large and small pipes, as shown in FIGS. 3 and 3*a*. The slots 46 and 48 are vertical so that the bolts 42 and 44 can easily be leveled with the threaded aperture in the leg members 30 and 32 respectively.

In order to increase the frictional abutment between the lower portions of the leg members 30 and 32 with the inner surface of the drain 14, friction means is also contemplated by providing a rubberized coating 50 such as synthetic rubber on their lower portion. The friction obtained by tightening the bolts 42 and 44 can be considerably increased to prevent any unintentional removal of the cover and even the removal by young children who are not ill-intentioned.

The rubberized coating may also be substituted by a serrated surface which will increase th gripping effect of the leg members on the drain.

Figure 7:
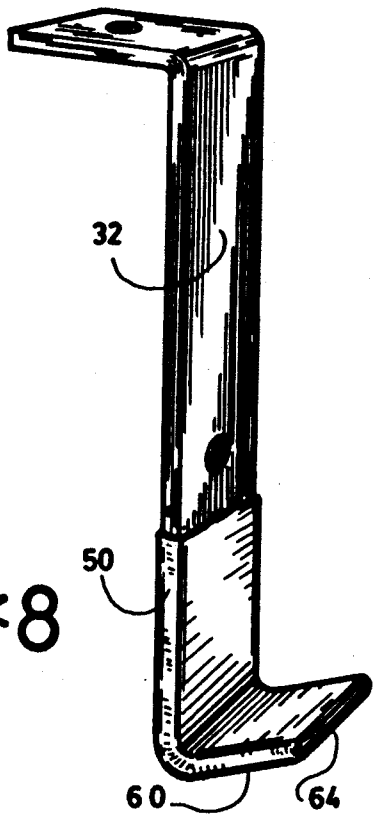
FIGS. 6 and 7 are respective views of two different embodiments of the leg members.
Figure 6:
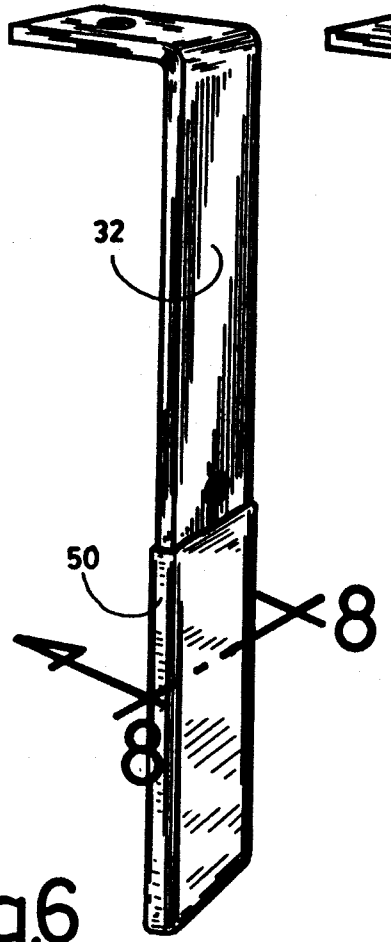
Figure 5:
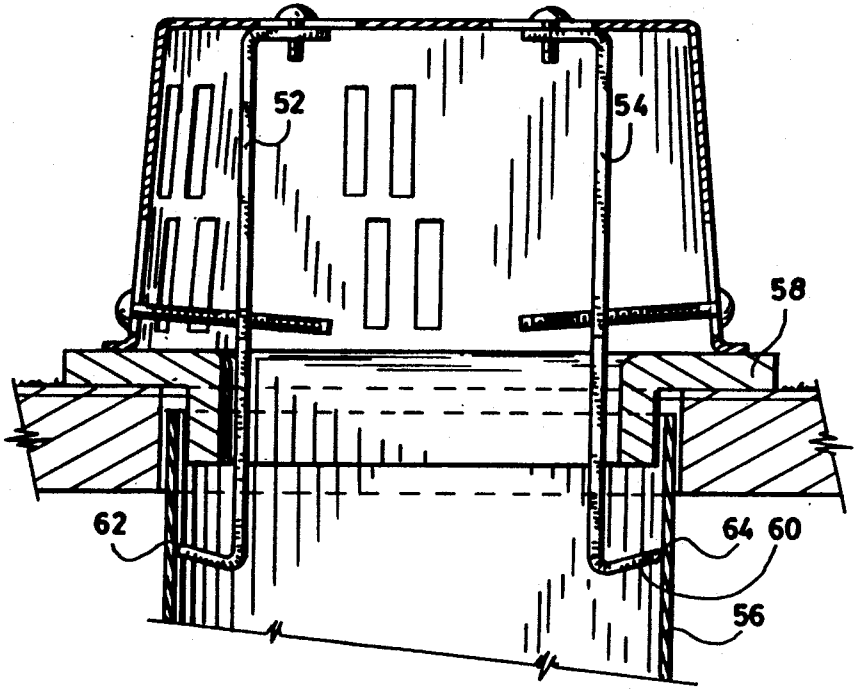
FIG. 5 is a cross-sectional view of the roof drain cover embodying a different type of leg member projecting inside the roof drain.
Figure 8:
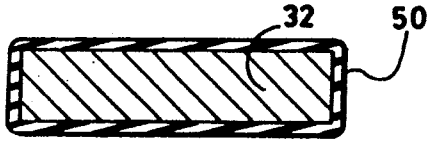
FIG. 8 is a cross-sectional view of the leg member along line 8—8 of FIG. 6.

Another alternative embodiment of the legs for the drain covers as contemplated by the present invention, is illustrated in FIGS. 5 and 7. The leg members 52 and 54 are bent outwardly to form a lip 60 at their lower edge so that the lower leading edges 62 and 64 can abut against the drain 56. The main vertical part of the leg members remain away from a collar 58 which is frequently provided between the roof 10 and the drain 56. The bent portion 60 of the lower end of the legs 52 and 54 are sufficiently long to prevent the contact of the leg members with the collar 58 but may be cut by the person making the installation so as to not exceed excessively inside the drain 58. It is also foreseen that the lower end and in particular the bent portion 60 is covered with a friction means such as rubberized coating to increase the resistance to the sliding of the leg members onto the vent pipe 56.

Considering that the bolts 42 and 44 are substantially coaxial, they could form a single threaded rod adapted to simultaneously spread apart with both leg members.

Figure 9:
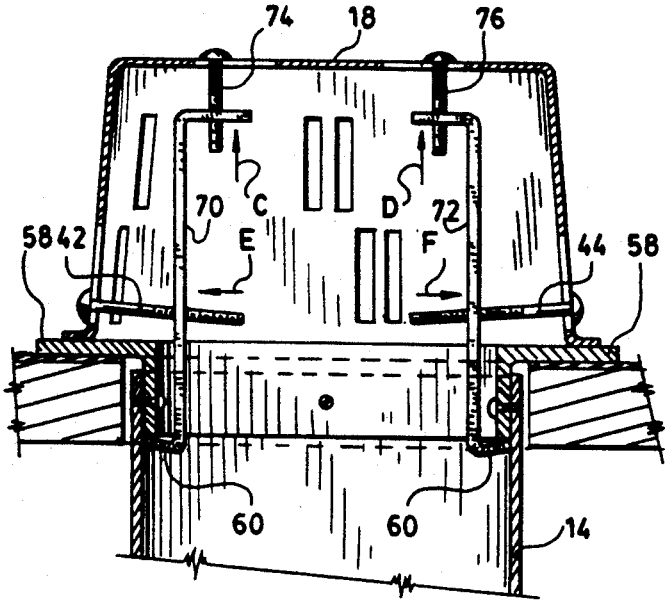
FIG. 9 is a cross-sectional view of an alternative embodiment of the invention including vertically adjustable leg members.
Figure 10:
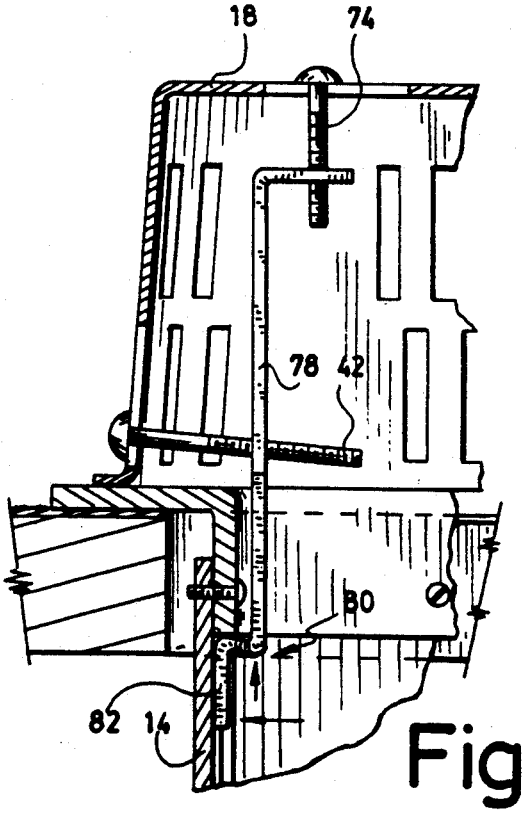
FIG. 10 is a portion of a cross-sectional view of a cover making use of a leg member of a different embodiment.

It is also contemplated by the present invention, that bolts 34 and 36 can allow the leg members to be vertically adjusted for bringing the bent portions 60 into abutment with the collar 58. Such an embodiment is shown in FIGS. 9 and 10. The legs 70 and 72 are suspended from the roof wall 18 by bolts 74 and 76 which are sufficiently long to allow their respective legs to be vertically moved in the direction of arrows C and D so as to tighten the bent portion 60 against the lower flange of the collar 58. The bolts 42 and 44 are subsequently tightened to pull the leg members 70 and 72 in the direction of the arrows E and F. Such an arrangement allows a more reliable gripping of the cover to the drain.

Figure 11:
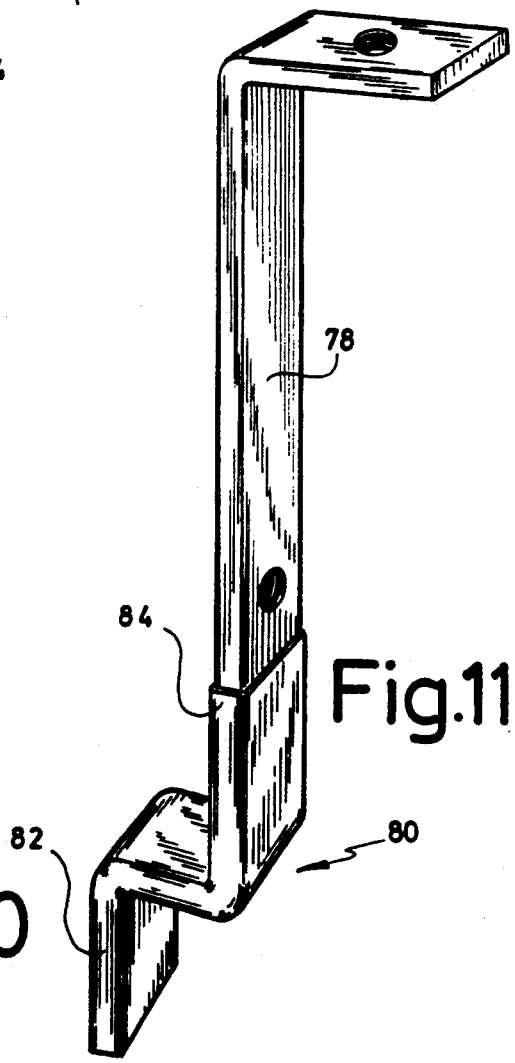
FIG. 11 is a perspective view of the leg member shown in FIG. 10.

The embodiment of the leg 78 shown in FIGS. 10 and 11 includes a double bent 80 in its lower portion to provide a flat flange 82 to abut against the inner wall of the drain 14. The large surface of the flange 82 increases the friction on the drain and prevents a sharp edge such as 62 in FIG. 5 from damaging the drain 14. A rubberized coating 84 is also contemplated for this embodiment.

Considering that the cover, including the cage and the bolts are generally in contact with water, the use of a rust-free material, such as aluminum is preferred.

Although the present cover is particularly adaptable to roof drains, it can also be used over vent pipes or the like.

I claim:

1. A roof drain cover comprising an open bottom end cage constructed and arranged to sit over the top of a roof drain, said cage having a top face provided with at least two diametrically opposite radial slots and an upstanding peripheral wall extending downwardly from said top face into a ledge constructed and arranged to sit over said top of the roof drain, said peripheral wall having at least two vertical slots facing each other, a pair of leg members interiorly disposed in said cage and having a lower portion extending below said ledge, and constructed and arranged to project inside said drain, each of said leg members having an upper end fixed to said top face, means for slidingly moving said leg members along said radial slots, said leg members being constructed and arranged to be variably spaced from each other, a pair of bolts, each of said bolts threadedly fixed through an intermediate portion of one of said leg members and slidingly mounted through one of said vertical slots, wherein said leg members are constructed and arranged to be pulled by said bolts for abutting against the interior surface of said drain to prevent removal of said cover.

2. A roof drain as recited in claim 1, comprising tightening means for immobilizing the upper end of said leg members along said radial slots.

3. A roof drain as recited in claim 2, wherein said leg members are provided with friction means for preventing the vertical sliding of the leg members abuting against the drain.

4. A roof drain as recited in claim 3, wherein said friction means comprises a coating of synthetic rubber on said leg members.

5. A roof drain as recited in claim 3, wherein said leg members have a lower end provided with an outwardly projecting lip, wherein said legs are constructed and arranged to grip the inner surface of said drain.

6. A roof drain as recited in claim 3, wherein said slots have a maximum width of ¼ inch.

7. A roof drain as recited in claim 1, wherein said leg members are vertically adjustable relative to said top face.

8. A roof drain cover constructed and arranged to be mounted over a roof drain, said cover comprising an open bottom end cage having a roof wall and a peripheral wall, said walls being provided with apertures for allowing water circulation therethrough, a pair of leg members suspended from said roof wall having a portion extending below said cage for penetrating into said roof drain, a pair of bolts slidingly mounted through said peripheral wall, said bolts being coaxially mounted in opposite direction, each of said bolts being threadedly engaged with said leg members for pulling apart said leg members, wherein said portions extending below the cage are constructed and arranged to abut against the inner surface of the drain for frictionally retaining said cage to said drain.

9. A roof drain cover as recited in claim 8, wherein each of said leg members is suspended from the roof wall by a bolt constructed and arranged to adjustingly space said leg members from said roof wall.

* * * * *